US010092096B1

(12) United States Patent
Reardon

(10) Patent No.: US 10,092,096 B1
(45) Date of Patent: Oct. 9, 2018

(54) RECIPE AND ACCESSORIES SYSTEM FOR THE KITCHEN

(71) Applicant: Deborah Reardon, Dallas, TX (US)

(72) Inventor: Deborah Reardon, Dallas, TX (US)

( * ) Notice: Subject to any disclaimer, the term of this patent is extended or adjusted under 35 U.S.C. 154(b) by 0 days.

(21) Appl. No.: 15/605,766

(22) Filed: May 25, 2017

Related U.S. Application Data

(60) Provisional application No. 62/341,240, filed on May 25, 2016.

(51) Int. Cl.
*A47B 63/00* (2006.01)
*A47B 97/04* (2006.01)
*A47B 77/02* (2006.01)

(52) U.S. Cl.
CPC ..... *A47B 63/00* (2013.01); *A47B 77/02* (2013.01); *A47B 97/04* (2013.01)

(58) Field of Classification Search
CPC ..... A47B 63/00; A47B 77/02; A47B 97/04
USPC ..... 312/257.1, 233, 231, 237
See application file for complete search history.

(56) References Cited

U.S. PATENT DOCUMENTS 5,107 A * 5/1847 Carter et al. ..... B62D 63/06 280/124.12
1,996,767 A * 4/1935 Hunter ..... A47B 17/036 312/223.4
3,351,402 A * 11/1967 Barecki ..... A47B 19/00 108/13
4,856,856 A * 8/1989 Winstone ..... A47B 23/046 206/1.7
5,025,964 A * 6/1991 Phirippidis ..... A47F 3/14 211/126.1
5,358,324 A * 10/1994 Liu ..... A47B 63/04 312/233
2012/0223035 A1* 9/2012 Kelley, III ..... A47B 19/002 211/85.1
2015/0130336 A1* 5/2015 Stewart ..... A47B 77/16 312/243

* cited by examiner

*Primary Examiner* — James O Hansen
(74) *Attorney, Agent, or Firm* — Jeffrey Roddy

(57) ABSTRACT

A system for the storage and retrieval of kitchen recipes and related items includes a kitchen recipe and article and accessories holder configured for the efficient use of limited kitchen counter-top space having a compartment with integrated book ends for storing cookbooks in an upright and slightly inclined position, plural cubbies for printed material, and a cookbook easel configured to easily support and display recipe information in printed or electronic formats.

5 Claims, 4 Drawing Sheets

RECIPE AND ACCESSORIES SYSTEM FOR THE KITCHEN

FIELD OF THE INVENTION

The present invention relates generally to a system for information storage and retrieval, and more specifically to kitchen recipe access and utilization.

BACKGROUND OF THE INVENTION

Most kitchens do not possess sufficient space for the efficient organizing of cookbooks, magazines and recipe card boxes, resulting in ad hoc storage schemes that often take the form of cluttered cupboards, inefficient use of cabinet space and misplaced or lost recipes.

What is needed is a system for storing and efficiently retrieving recipes, whether stored in the form of cookbooks, index cards, magazine articles, print outs or electronic media.

Within such a system, it would be desirable to a provide a kitchen recipe and article and accessories holder configured for the efficient use of limited kitchen counter-top space.

It would be desirable if such a kitchen recipe and article and accessories holder include plural cubbies for printed material, a recipe card box, index cards, an easel and cooking related miscellany.

It would be even more desirable if an easel of the system were configured for the retention and display of loose paper, cookbooks, index cards and electronic tablets or smart phones.

SUMMARY OF THE INVENTION

The present invention a system for the space efficient storage and retrieval of recipes and recipe related items.

In one aspect of the present invention, the system includes a kitchen recipe and article and accessories holder having a dedicated space for cookbooks and plural cubbies for preserving printed material for ready access.

In another aspect of the present invention, portions of the kitchen recipe and article and accessories holder are adapted to store an easel so that printed material or recipes accessed via an electronic tablet may be removed from the holder and displayed in a convenient manner.

In yet another aspect of the present invention, the kitchen recipe and article and accessories holder may share design elements of certain kitchen appliances in color, surface treatment and/or material construction. For example, the materials of construction may be stainless steel, brushed aluminum, wood, plastic, glass, stone or any combination of the foregoing.

In still another aspect of the present invention, the kitchen recipe and article and accessories holder may incorporate a charging station for an electronic device such as a tablet or smart phone.

In any of the foregoing aspects, contents of the kitchen recipe and article and accessories holder may be secured by lockable cubbies.

In any of the foregoing aspects, although the kitchen recipe and article and accessories holder typically sits on a counter top, it may be adapted to mount to the underside of a kitchen cabinet or to a wall or another surface.

It will be appreciated by those of ordinary skill in the art that the overall size and contour of the kitchen recipe and article and accessories holder can vary depending on space constraints.

The foregoing and other objects, features, and advantages of the invention will become more apparent from the following detailed description, which proceeds with reference to the accompanying figures wherein the scale depicted is approximate.

DETAILED DESCRIPTION OF THE INVENTION

Reference Listing of Elements

Figure 1:
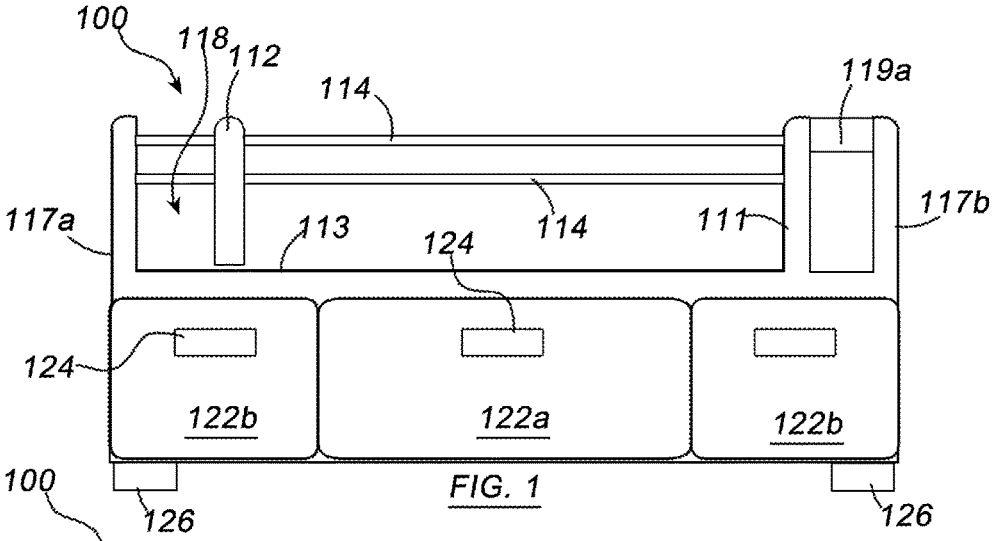
FIG. 1 is a front side elevation of one general embodiment according to the present invention.
Figure 2:
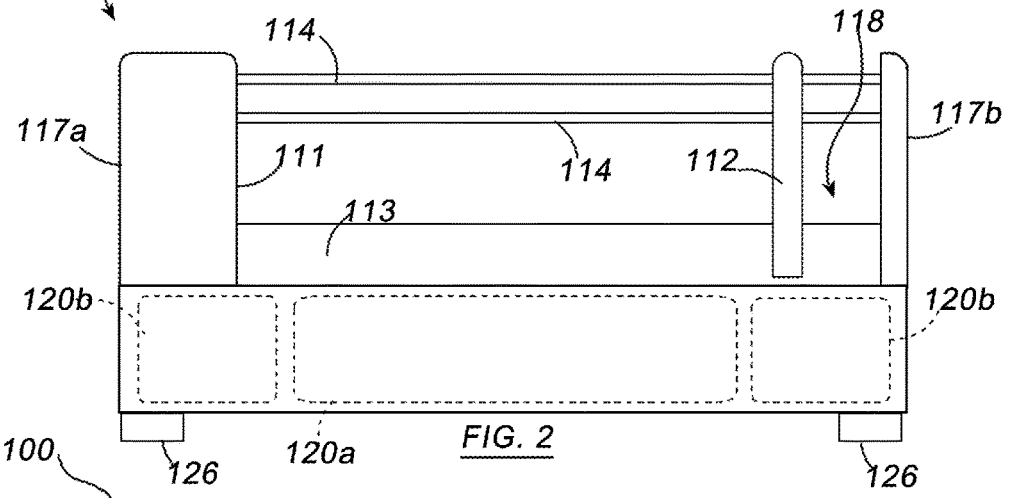
FIG. 2 is a back side elevation thereof.
Figure 3:
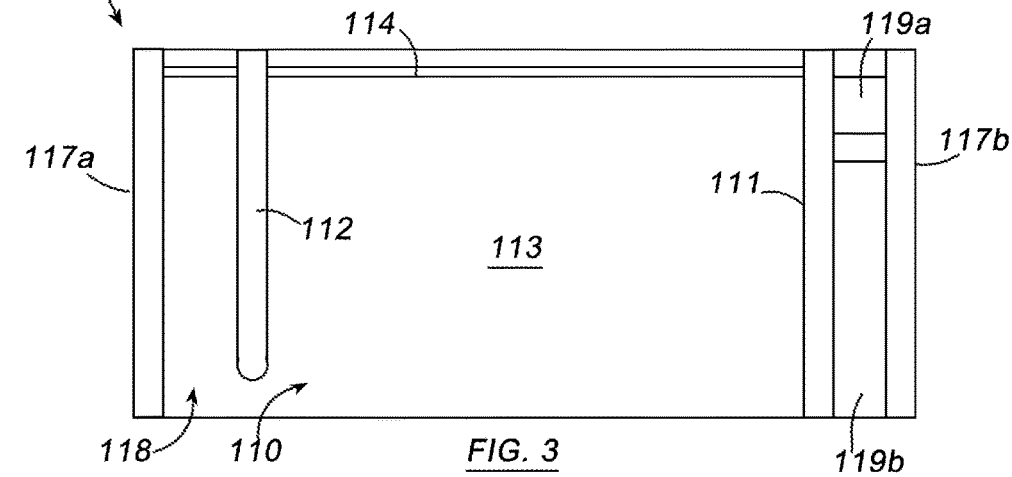
FIG. 3 is a top plan view thereof.
Figure 4:
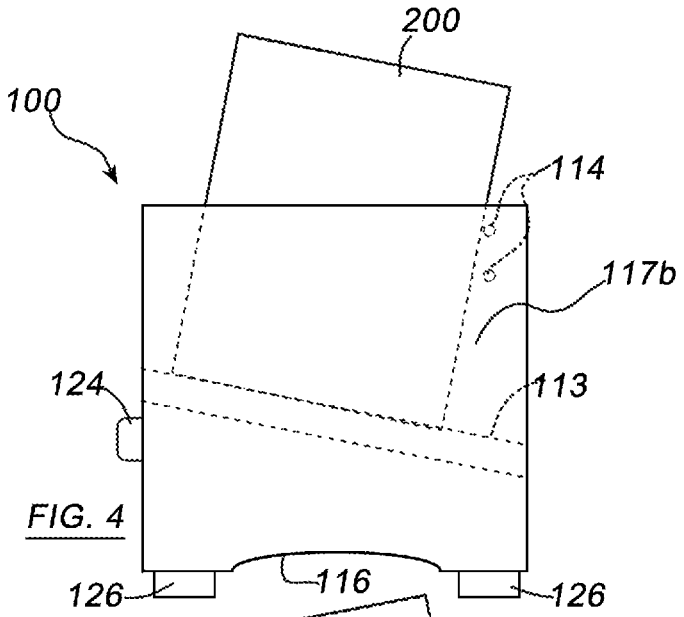
FIG. 4 is a right end view thereof.
Figure 5:
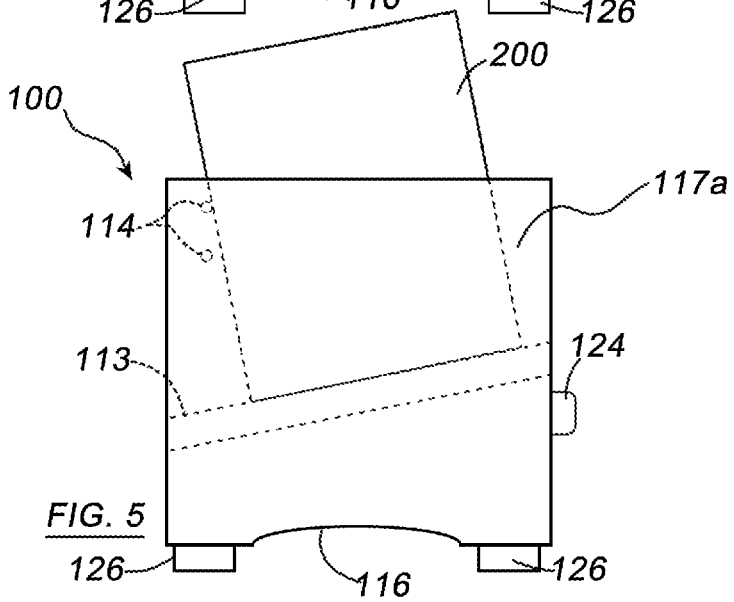
FIG. 5 is a left end view thereof.

100 kitchen recipe and article and accessories holder
110 book recess
111 fixed book end
112 slidable book end
113 book recess base
114 book rail
116 end handle
117*a*, 117*b* holder ends
118 recipe card box cubby
119*a* top first cubby
119*b* top second cubby
120*a* central cubby
120*b* side cubby
122*a* central cubby front
122*b* side cubby front
124 cubby handle
126 feet
128 easel
130 easel arms
131 slidable tablet clamp
132 card clip
134 easel stand
135 charger access slot
200 cookbook
210 recipe index card
220 electronic device

Definitions

In the following description, the term "cubby" refers to pockets, slots, drawers, pouches and/or recesses that are adapted to store printed material or small kitchen articles and recipe related items. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-9, a system for organizing kitchen recipes whether in printed or electronic form, includes a kitchen recipe and article and accessories holder 100 having an upper section including a recess 110 for cookbooks 200 with integrated book ends; one fixed 111 partition and one slidable 112 partition that may be used to stabilize and partition cookbooks from, for example, a recipe card box placed in recipe card box cubby 118 which is re-sizable by sliding partition 112. Recess 110 is bounded by rails 114 that serve as a guide for the slidable book end, and includes an inclined base 113 to orient the stored cookbooks in a position best able to display the cookbook title. To the left or right side of recess 110 is a cubby that is shown divided into two sections 119*a*, 119*b* adapted for small kitchen articles and miscellany such as book marks, writing implements and notepads. To the left or right side of recess 110 and between slidable partition 112 and an end 117*a* of the holder is a recipe card box cubby 118 that is sized and shaped to nest a recipe card box therein. Below inclined base 113 is a lower section which includes plural cubbies including a central cubby 120*a* for storing/hiding a cookbook easel, and two smaller cubbies 120*b* with drawer fronts to left and right of the central cubby 120*a*. The smaller cubbies may be configured to be of sufficient length, width and height to store small items. Facing central cubby 120*a* is a pivoting front 122*a*, or a panel that may hinge downwardly. Conceivably, the panel may also pivot upwardly into the cubby, albeit with a loss of cubby space. It is also possible that the fronts may be of a pliant material that may be pleated or possess accordion folds in order to reversibly collapse and expose a cubby interior. The kitchen recipe and article and accessories holder 100 includes an easel 128 typically stored in the central cubby when not is use, and adapted to support and display printed material such as a cookbook, a magazine, an index card 210, an electronic tablet 220 or the like.

FIGS. 1-5 show respectively, front, back, top and end views of one exemplary embodiment of a kitchen recipe and article and accessories holder 100. The particular incline of base 113 indicated by the dashed lines shown in FIGS. 4 and 5 may be any desirable angle suited for the optimal display of cookbook titles, and to securely nest and retain the cookbooks.

Figure 6:
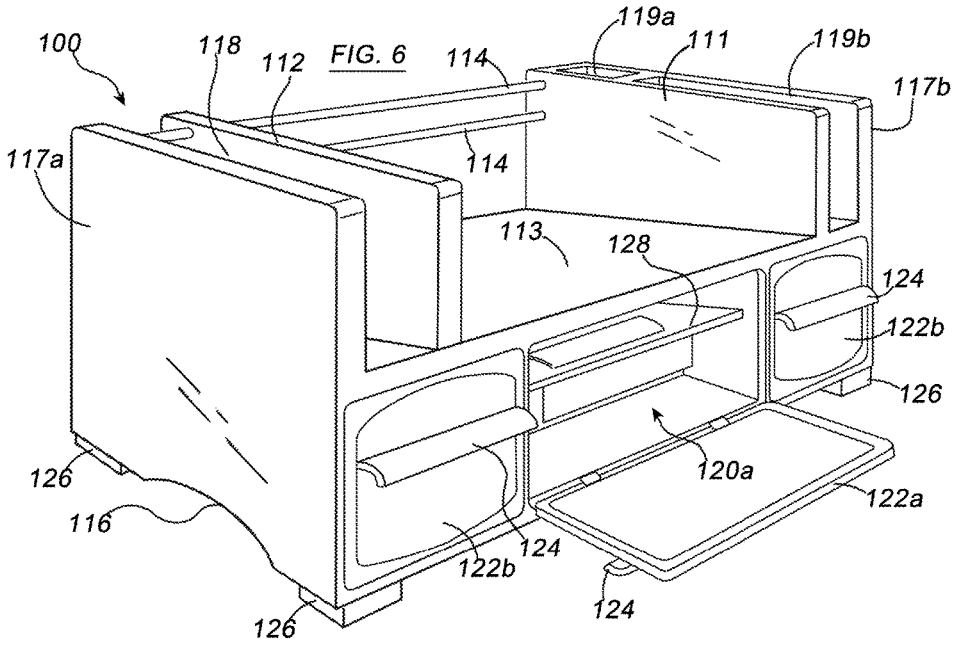
FIG. 6 is a perspective view thereof showing an open central cubby for an easel.
Figure 7:
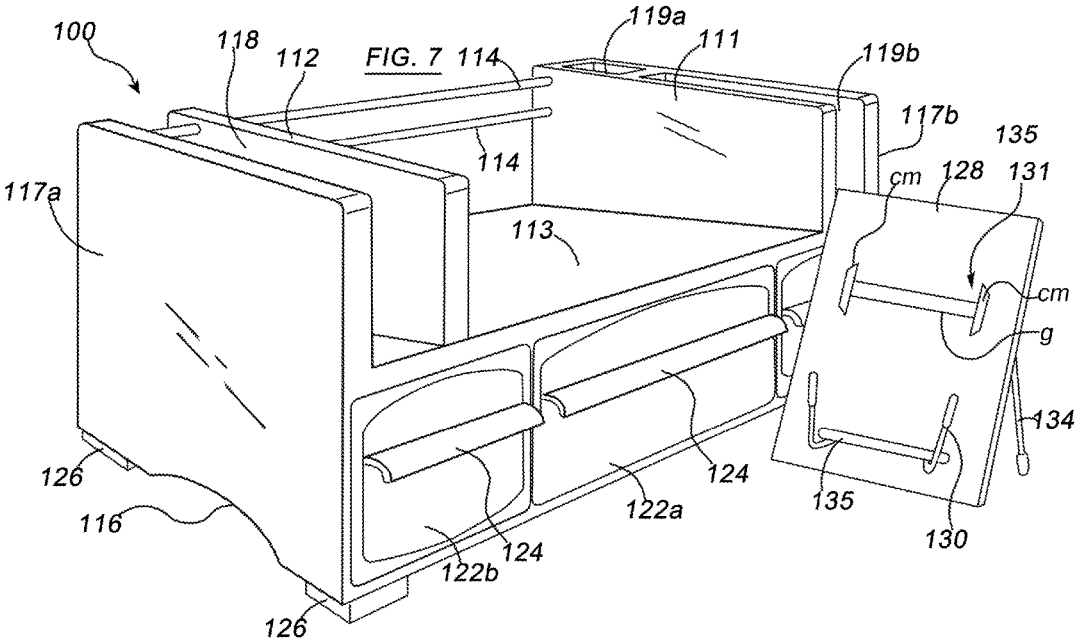
FIG. 7 is a perspective view thereof showing the central cubby shut and the easel now removed from the central cubby and standing.

FIGS. 6 and 7 are perspective views that illustrate various structural features of the kitchen recipe and article and accessories holder 100. Although in the particular embodiment shown, easel 128 is depicted as being stored in the middle and largest cubby, the cubby configuration depicted is merely exemplary and the kitchen recipe and article and accessories holder 100 may possess one relatively large undivided cubby with a single cubby front, or any practical number of cubbies, or divided compartments accessible via any number of cubby fronts 122 subject to the functional requirements of recipe item and easel storage as specified in this disclosure. Easel 128 may be equipped with a slot 135 to admit a charging cord for an electronic device.

Although in the particular embodiment shown, kitchen recipe and article and accessories holder 100 is depicted with feet 126, some embodiments may lack feet or any feet if present, may be removable to accommodate counter-top to under cabinet space constraints.

Figure 8:
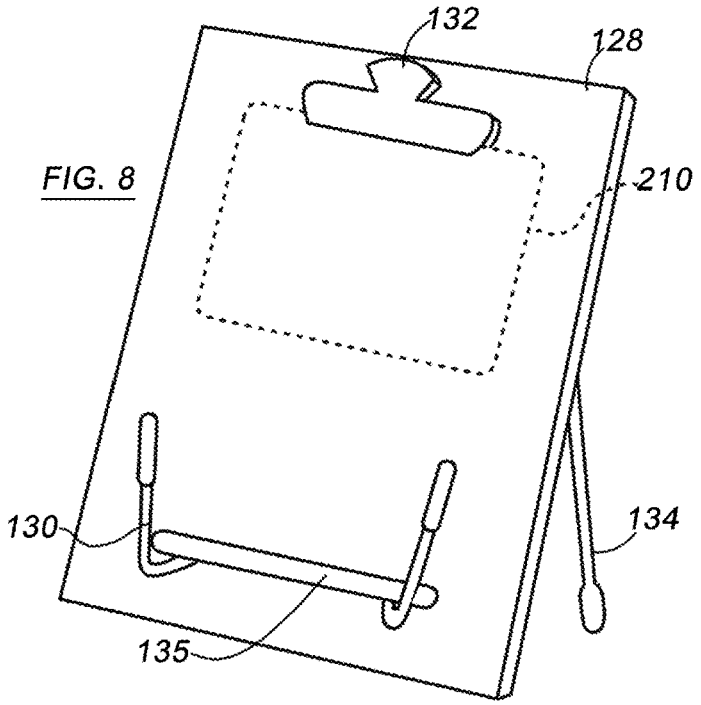
FIG. 8 according to embodiments of the invention, depicts an easel adapted for use with index cards.
Figure 9:
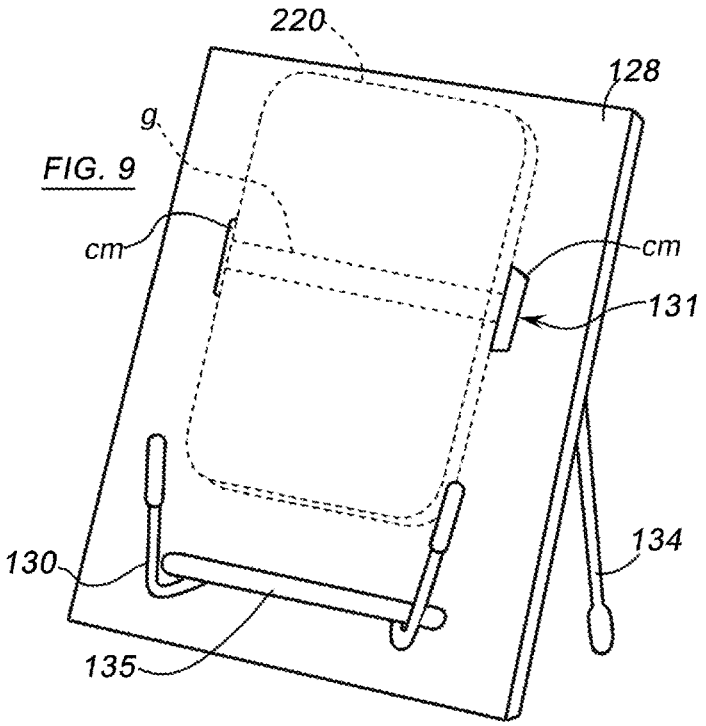
FIG. 9 according to embodiments of the invention, depicts an easel adapted for use with a tablet or smart phone.

FIGS. 8 and 9 depict respectively, a cookbook easel 128 adapted to retain a paper article or index card to the easel by a recipe card clip 132 or other suitable means, or, secure a tablet or other electronic device to the easel using width adjustable clamp 131 that is adapted to slidably clamp a mobile computing device or a book from the sides whereby the clamping members (cm) are movable inwardly or outwardly along guide (g). Easel 128 includes support arms 130 adapted to support a cookbook and folding easel stand 134.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A system for the storage and retrieval of kitchen recipes and related items comprising:

a compartmentalized kitchen recipe and article and accessories holder comprising a bottom, a top side, a front side, a back side and two stationary end portions, the compartmentalized kitchen recipe and article and accessories holder further comprising:

(i) an upper level comprising: an open topped book recess including a stationary inclined surface configured to slope downwardly from the front side to the back side, a slidable partition including at least one planar surface disposed between the stationary end portions defining a first book end, and, at least one upper cubby disposed between the slidable partition and one of the stationary end portions, the at least one upper cubby configured to hold small articles;

(ii) a lower level comprising: a central cubby including a pivotable front panel and a storage recess behind the front panel, and, a first side cubby disposed between the central cubby and one of the two stationary end portions; and, (iii) a self supportable easel configured to support a cookbook or a mobile computing device, the easel including a projecting portion configured to support the cookbook or the mobile computing device, the easel is configured to be readily separable from the compartmentalized kitchen recipe and article and accessories holder, and the easel is configured for compact horizontal storage in the storage recess.

2. The kitchen recipe and article and accessories holder according to claim 1, wherein the central cubby is configured to house the easel when the easel is not in use.

3. The kitchen recipe and article and accessories holder according to claim 1, further comprising a immovable partition defining a second book end which is opposite the slidable partition.

4. The kitchen recipe and article and accessories holder according to claim 1, wherein the lower level further comprises a second side cubby.

5. The kitchen recipe and article and accessories holder according to claim 1, wherein the easel includes an aperture for the passing through of a power cord.

* * * * *